US006907681B2

(12) United States Patent
Tanaka et al.

(10) Patent No.: US 6,907,681 B2
(45) Date of Patent: Jun. 21, 2005

(54) RESIN SAFETY SHOE TOE CAP

(75) Inventors: Yoshiharu Tanaka, Nyuzen-machi (JP); Mutsuo Hirota, Asahi-machi (JP); Tomohisa Ishida, Kawaguchi (JP)

(73) Assignee: YKK Corporation, Tokyo (JP)

( * ) Notice: Subject to any disclaimer, the term of this patent is extended or adjusted under 35 U.S.C. 154(b) by 33 days.

(21) Appl. No.: 10/455,028

(22) Filed: Jun. 5, 2003

(65) Prior Publication Data

US 2004/0009337 A1 Jan. 15, 2004

(30) Foreign Application Priority Data

Jul. 11, 2002 (JP) ..... 2002-202357

(51) Int. Cl.[7] ..... A43C 13/14
(52) U.S. Cl. ..... 36/77 R; 36/77 M
(58) Field of Search ..... 36/77 R, 77 M

(56) References Cited

U.S. PATENT DOCUMENTS

| | | | | |
|---|---|---|---|---|
| 4,862,606 A | * | 9/1989 | Siskind et al. | 36/77 M |
| 5,331,751 A | | 7/1994 | Harwood | |
| 5,809,666 A | * | 9/1998 | Harwood | 36/77 R |
| 6,333,105 B1 | | 12/2001 | Tanaka et al. | |
| 6,367,170 B1 | * | 4/2002 | Williams | 36/77 M |

FOREIGN PATENT DOCUMENTS

| | | | |
|---|---|---|---|
| DE | 43 20 312 A1 | | 1/1994 |
| EP | 0100181 | * | 2/1984 |
| EP | 1 033 231 A2 | | 9/2000 |
| GB | 2071989 | * | 9/1981 |
| GB | 2 138 272 A | | 10/1984 |
| JP | 2574860 | | 4/1998 |
| JP | 2598209 | | 6/1999 |
| JP | 2000-238142 | | 9/2000 |
| WO | WO 98/48999 | | 11/1998 |

* cited by examiner

*Primary Examiner*—M. D. Patterson
(74) *Attorney, Agent, or Firm*—Michael S. Leonard; Everest Intellectual Property Law Group

(57) ABSTRACT

A resin safety shoe toe cap made from a fiber-reinforced thermoplastic resin, wherein the toe cap resin safety shoe toe cap is constituted from rising parts comprising a front end rising part 1, a big toe side rising part 2 and a little toe side rising part 3; a top part 6; and a base part 5, wherein the thickness of the big toe side rising part 2 is made to be greater than the thickness of the little toe side rising part 3. Moreover, the big toe side rising part 2 and the little toe side rising part 3 are connected to the front end rising part 1 by curved surface parts 4 having different curvatures, and the rising parts are formed so as to rise up approximately perpendicularly to the base part 5. The safety shoe toe cap not only satisfies the performances in L-class and S-class of JIS T 8101, but also the impact resistance and compression resistance performances stipulated in H-class of JIS T 8101 and safety shoe standards in the CEN Standard, without impairing the ability to fit to shoes and wearer's feet.

10 Claims, 3 Drawing Sheets

RESIN SAFETY SHOE TOE CAP

BACKGROUND OF THE INVENTION

1. Field of the Invention

The present invention relates to safety shoe toe caps that are applied to shoes, boots or the like to structurally reinforce the shoe toes, thereby enhancing increasing their safety.

2. Description of the Prior Art

Regarding the toe caps in safety shoes, a great importance has hitherto been attached to the strength of the part at the upper of shoes for the protection against the dropping of a heavy material, and hence steel toe caps have been put to practical use. Since, however, safety shoes with steel toe caps are heavy, there occurs a problem with the workability of a person wearing such shoes. For this reason, in recent years, to make safety shoes lighter, toe caps made of a thermoplastic resin reinforced with reinforcing fibers, such as glass fibers, have thus been developed.

Among conventional safety shoe toe caps made of a reinforcing fiber-containing thermoplastic resin, for example, materials used therein are known from the disclosure of Japanese Patent Publication No. 2000-238142. Japanese Patent Publication No. 2000-238142 discloses a safety shoe toe cap that satisfies the strength required in L-class and S-class, which are used for classification of safety shoes according to work divisions in JIS (Japanese Industrial Standard) T 8101. However, although the toe cap disclosed in Japanese Patent Publication No. 2000-238142 is satisfactory from the viewpoint of the strength levels required in L-class and S-class of JIS T 8101, there is a problem that H-class of JIS T 8101, in which a higher strength is required, and the safety shoe standards in CEN Standard (coping with an impact energy of 200 J) cannot be satisfied merely through the material, since there is a limit on the reinforcing fiber content.

Moving on, as disclosed in FIGS. 1, 2 and 5 in Japanese Utility Model Registration No. 2574860, a safety shoe toe cap has a shape in which the tip of the front end part of the toe cap is displaced to the big toe side, this being to make the fit to the inserted foot good, and also in relation to the external shape of the shoe in which the toe cap is installed. However, in the case that the toe cap is subjected to a greater force or load, in relation to the strength the above-mentioned toe cap shape gives rise to a strength imbalance, that is the big toe side is subjected to a larger load, leading to damage to the big toe side rising part.

Furthermore, as disclosed in FIG. 3 in Japanese Utility Model Registration No. 2598209, a safety shoe toe cap is formed such that the top part expands out relative to the base part from the front end side toward the rear end side, this being to make the fit to the inserted foot good, and also in relation to the external shape of the shoe in which the toe cap is installed. However, in the case that the toe cap is subjected to a greater force or load, due to the above-mentioned toe cap shape, the connecting part between the front end rising part and the top part is subjected to a large load, leading to damage at this connecting part. To improve such a problem, an improvement measure has been adopted in which the connecting part is made to be thicker than the other parts (the front end rising part and the top part), but when considering the fit to shoes and feet, there are also limits in such a measure.

SUMMARY OF THE INVENTION

In view of the above, it is thus an object of the present invention to provide a safety shoe toe cap that not only satisfies the performances required in L-class and S-class of JIS T 8101, but also satisfies the impact resistance and compression resistance performances stipulated in H-class of JIS T 8101 and safety shoe standards in the CEN Standard. Furthermore, it is an object of the present invention to provide a safety shoe toe cap that is useful strengthwise as described above but with no impairment of the ability to fit to a shoe and foot.

To solve the above problems, the present invention is constituted as follows.

(1) A resin safety shoe toe cap made from a fiber-reinforced thermoplastic resin, wherein the toe cap satisfies the impact resistance and compression resistance performances stipulated in H-class standards required of safety shoes for heavy work in JIS T 8101.

(2) A resin safety shoe toe cap made from a fiber-reinforced thermoplastic resin, wherein the toe cap satisfies the impact resistance and compression resistance performances stipulated in safety shoe standards in CEN Standard as a unified European Standard.

(3) The resin safety shoe toe cap according to (1) or (2) above, wherein the resin safety shoe toe cap is constituted from rising parts consisting of a front end rising part, a big toe side rising part, and a little toe side rising part; a top part; and a base part, wherein the thickness of the big toe side rising part is made to be greater than the thickness of the little toe side rising part.

(4) The resin safety shoe toe cap according to (3) above, wherein the big toe side rising part and the little toe side rising part are connected to the front end rising part by curved surface parts having different curvatures, and the thicknesses of the big toe side rising part and the little toe side rising part differ at at least the curved surface parts.

(5) The resin safety shoe toe cap according to (1) or (2) above, wherein the resin safety shoe toe cap is constituted from rising parts consisting of a front end rising part, a big toe side rising part and a little toe side rising part; a top part; and a base part, wherein the rising parts consisting of the front end rising part, the big toe side rising part and the little toe side rising part are formed so as to rise up approximately perpendicularly to the base part.

(6) The resin safety shoe toe cap according to (1) or (2) above, wherein the resin safety shoe toe cap is constituted from rising parts consisting of a front end rising part, a big toe side rising part and a little toe side rising part; a top part; and a base part, wherein the amount of change in the height of the top part relative to the base part is not more than 7 mm.

(7) The resin safety shoe toe cap according to (1) or (2) above, wherein the reinforcing fibers are glass fibers, and the thermoplastic resin is at least one selected from the group consisting of nylon, polypropylene and thermoplastic polyurethane.

(8) The resin safety shoe toe cap according to (1) or (2) above, wherein the reinforcing fibers have a fiber diameter of 0.2 to 5 mm and a length of 10 to 80 mm, and the content by weight of the reinforcing fibers in the fiber-reinforced thermoplastic resin is 45 to 75%.

In this way, the safety shoe toe cap uses a thermoplastic resin having reinforcing fibers blended therein, satisfies impact resistance and compression resistance, and structurally protects the shoe toe when applied to shoes, boots or the like, thus increasing their safety.

DETAILED DESCRIPTION OF THE PREFERRED EMBODIMENTS

Figure 1:
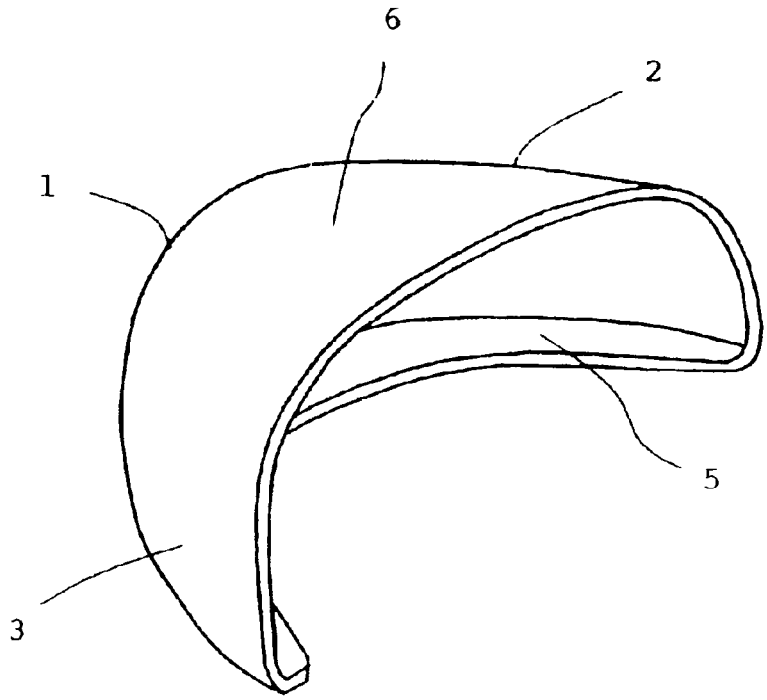
FIG. 1 is a perspective view of an example of the present invention.

In the present invention, a resin safety shoe toe cap that comprises a fiber-reinforced thermoplastic resin is characterized by satisfying impact resistance and compression resistance performances stipulated in H-class standards for heavy work in JIS T 8101, or by satisfying impact resistance and compression resistance performances stipulated in safety shoe standards in unified European Standard CEN. Here, in H-class standards for heavy work in JIS T 8101, it is required as impact resistance performance that when an impact energy of 100 J (10.2 kgf·m) has been applied to the toe cap, the clearance height is at least a prescribed value, and there are no cracks that let light pass through, and moreover it is required as compression resistance performance that when a 1531 kgf compressive load has been applied to the toe cap, the clearance height is at least a prescribed value, and there are no cracks that let light pass through. On the other hand, in the safety shoe standards in the unified European Standard CEN Standard, it is required as impact resistance performance that when an impact energy of 200 J (20.4 kgf·m) has been applied to the toe cap, the clearance height is at least a prescribed value, and there are no cracks that permits the passing of light. Moreover it is required as compression resistance performance that when a 1530 kgf compressive force has been applied to the toe cap, the clearance height is at least a prescribed value, and there are no cracks that permits the passing of light. In the above, regarding the meaning of the clearance height being at least a prescribed value, the stipulated clearance height varies according to the safety shoe size; according to the stipulations, for example, in the case that the safety shoe size is 23.5 to 24.5 cm, the clearance height must be at least 13 cm, in the case that the safety shoe size is 25 to 25.5 cm, the clearance height must be at least 13.5 cm, and in the case that the safety shoe size is 26 to 27 cm, the clearance height must be at least 14 cm.

Furthermore, in the present invention, by making the thickness of the big toe side rising part greater than the thickness of the little toe side rising part, it is possible to provide a safety shoe toe cap which has a shape that has a good fit to the inserted foot and conforms to the external shape of the shoe in which the toe cap is installed, and which, even if the tip of the front end part is displaced to the big toe side, can eliminate the problem of strength imbalance due to this shape, and hence is more useful strength-wise than current toe caps, but with no impairment of the ability to fit to the shoe and foot, which is an object of the present invention.

Furthermore, in order that a force that acts to deform the rear end part (the opening part) of the toe cap can be withstood at the front end side of the toe cap when the toe cap is subjected to a great load force in particular, it is preferable to make the thickness of the big toe side rising part greater than the thickness of the little toe side rising part at at least curved surface parts; to give this variation in thickness, and to relax a concentrated load caused by deformation of the rear end side (the opening part) of the toe cap toward the tip of the front end rising part, it is preferable to form different curved surface parts with different curvatures between the front end rising part and the big toe side rising part and between the front end rising part and the little toe side rising part, rather than the same curved surface.

Moreover, in the present invention, by forming the rising parts comprising the front end rising part, the big toe side rising part and the little toe side rising part so as to rise up approximately perpendicularly to the base part, it becomes that a load from above the toe cap is borne directly at the front end rising part, the big toe side rising part and the little toe side rising part, and hence a toe cap that is particularly useful from the viewpoint of strength can be provided.

Furthermore, by making the amount of change in the height of the top part relative to the base part be not more than 7 mm, deformation of the rear end side (the opening part) of the toe cap can be reduced, and it becomes that the load is borne at the front end rising part, and also the big toe side rising part and the little toe side rising part during the initial stage of deformation, and hence a toe cap that is useful from the viewpoint of strength perspective can be provided. In the above, the amount of change indicates the difference in height between the rear end of the top part and the tip of the top part; the tip of the top part is the place on the top part side where the top part is connected to the curved surface part formed between the top part and the front end rising part. Furthermore, it is particularly preferable for the amount of change between the place on the top part where the height is a maximum and the place on the top part where the height is a minimum to be not more than 7 mm.

Although there presently exist fiber-reinforced thermoplastic resins and fiber-reinforced thermosetting resins as the materials for the resin safety shoe toe caps of the present invention, fiber-reinforced thermoplastic resins are preferable from the viewpoint of moldability and so on. The fiber-reinforced thermoplastic resins used in the present invention comprises reinforcing fibers and thermoplastic resins; as the reinforcing fibers, there are no particular limitations, but examples are glass fibers, carbon fibers, aramid fibers and so on, and in the case that the cost and so on is considered, it is particularly preferable to use glass fibers. As the thermoplastic resins, there are no particular limitations, but for example polyethylene, polypropylene, nylon, polyethylene terephthalate, polybutylene terephthalate, polystyrene, an AS (acrylonitrile-styrene) resin, an ABS (acrylonitrile-butadiene-styrene) resin, PPS (polyphenylene sulfide), PEI (polyetherimide), PEEK (polyether ether ketone), thermoplastic polyurethane, and so on can be suitably used.

If necessary, known additives such as colorants, modifiers, and fillers other than glass fibers can be included in these thermoplastic resins as appropriate; these additives are kneaded and used following conventional methods. In the above, from the viewpoint of moldability, cost or the like, it is particularly preferable to use nylon, polypropylene, or thermoplastic polyurethane.

As a method of manufacturing the resin safety shoe toe cap of the present invention, it is possible to prepare a reinforcing fiber-containing thermoplastic resin sheet material, cut the sheet material into a shape in accordance with the toe cap to be manufactured, melt/soften the cut sheet material by heating using, for example, a far infrared furnace, put the melted/softened material into a molding die, and carry out compression molding while heating under application of pressure. Moreover, it is also possible to carry out the manufacture by putting fiber-reinforced thermoplastic resin pellets into a quasi-molding die, carrying out primary molding them into a toe cap preform by compressing the pellets while heating, putting the toe cap preform obtained into a molding die for the intended safety shoe toe cap, and compression molding the preform into the safety shoe toe cap by heating under application of pressure. The latter method is preferable compared with the former method, since the later can provide products with less fluctuation in strength, and its production procedure can be efficiently conducted without requiring the steps of sheet cutting and sheet melting/softening. The description relating to the method hereinafter is for the latter manufacturing method.

The fiber-reinforced thermoplastic resin pellets in the present invention are, for example, obtained by passing, through a preheating oven, reinforcing fiber strands pulled out from a plurality of rovings, introducing the reinforcing fiber strands into a die for incorporating them into a resin, feeding into the die a molten resin that has been heated and kneaded using an extruder, impregnating the reinforcing fiber strands with the thermoplastic resin in the die, cooling, and then cutting the reinforcing fibers impregnated with thermoplastic resin to a prescribed length using a pelletizer. Regarding the fiber diameter and the length of the reinforcing fibers, there are no particular limitations, but for the purpose of automatic weighing and plasticization, 0.2 to 5 mm is suitable as the diameter, and 10 to 80 mm is suitable as the length. It is undesirable for the diameter to be less than 0.2 mm, since in this case the pellets themselves will become light, and thus automatic weighing will become difficult. On the other hand, if the diameter exceeds 5 mm, then the plasticization time will become long. Regarding the length, in relation to the product, in the case that the length is less than 10 mm, the reinforcing effect will not be obtained, and hence it will not be possible to obtain a toe cap that is excellent in terms of strength, and in the case that the length exceeds 80 mm, it will no longer be possible to carry out molding easily, and thus the above-mentioned range is preferable; the same applies in the case of the above-mentioned sheet material.

The content of the reinforcing fibers in the fiber-reinforced thermoplastic resin pellets is preferably 45 to 75% by weight percentage (27 to 58 vol. % by volume percentage); if the reinforcing fiber content is less than 45 wt. % by weight percentage, then the reinforcing fiber content will be insufficient, and hence it will be difficult to provide a high-strength toe cap, and if the reinforcing fiber content exceeds 75% by weight, then the amount of the resin relative to the amount of the reinforcing fibers will become too low, and hence a strength imbalance will arise, leading to a drop in strength, and moreover molding will become difficult.

The weight of the safety shoe toe cap to be manufactured depends on the size of the safety shoe, while it is generally in the rage of 20 to 120 g.

Following is a description of the present invention through examples; however, the present invention is, of course, not limited to the following examples. In the following examples, the contents of reinforcing fibers are expressed by weight percentage based on the total weight of the fibers and the thermoplastic resin used unless otherwise specified.

EXAMPLE 1

Pellets of a thermoplastic resin reinforced with fibers having a fiber diameter of approximately 0.5 mm and cut to a length of 20 mm (containing 60 wt. % of glass fibers in polyurethane) were weighed out, and primary molding was carried out by plasticizing through heating in a quasi-molding die (0.5 minutes at 210° C. under application of a pressure of 0.5 kg/cm$^2$), thus preparing a preform of a toe cap. This was put into a toe cap molding die, and compression molding was carried out at 135° C. under application of a pressure of 400 kg/cm$^2$, thus manufacturing a toe cap for safety shoes of size 26 cm.

Figure 2:
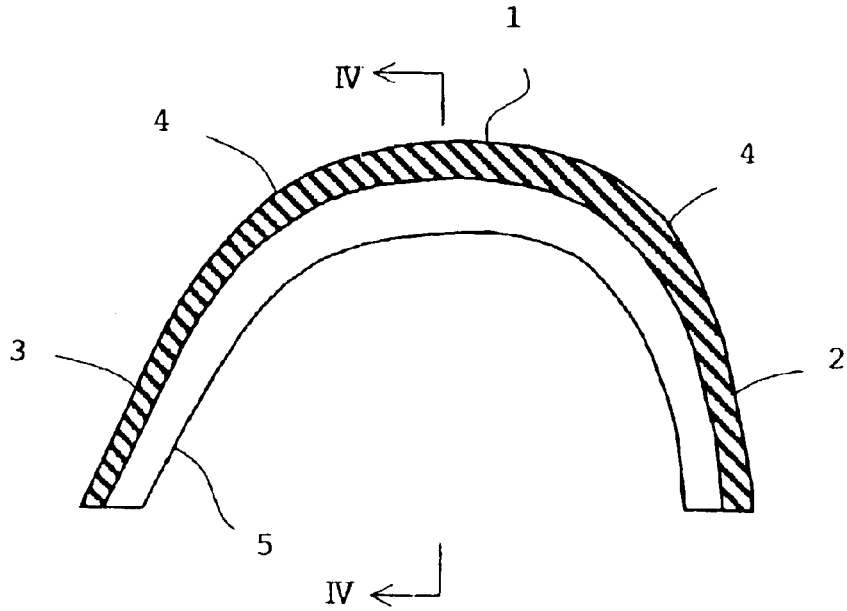
FIG. 2 is a cross-sectional view of the example of FIG. 1.
Figure 3:
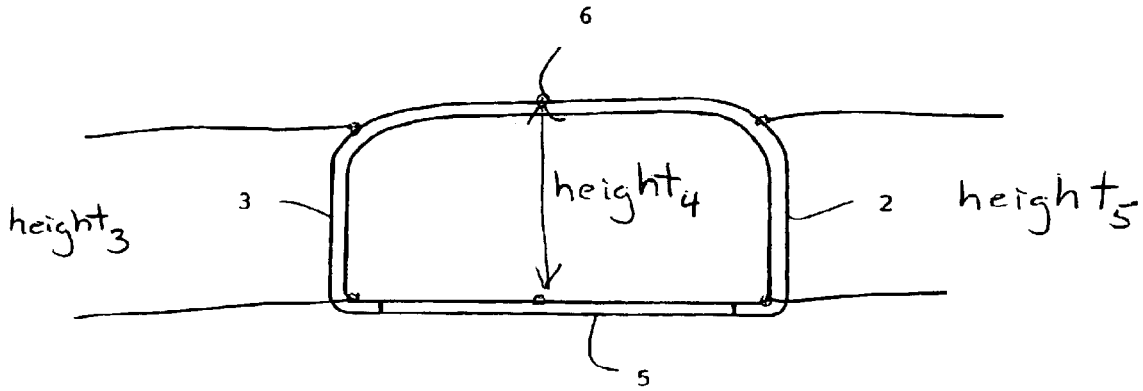
FIG. 3 is a rear view of the example of FIG. 1.
Figure 4:
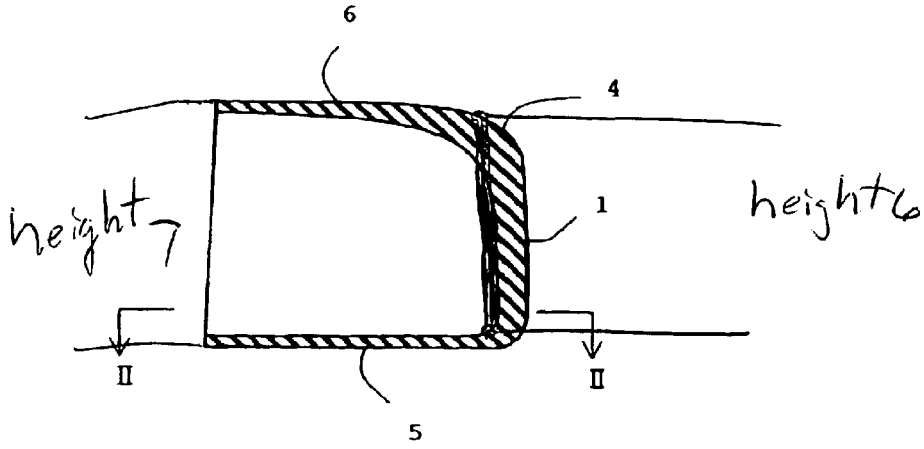
FIG. 4 is a sectional view along the line IV—IV of FIG. 2.

The form of the manufactured toe cap was as shown in FIGS. 1 to 4. As shown in FIG. 2, this form has a front end rising part 1 comprising a composite curved surface of radius 18 mm on the big toe side and radius 22 mm on the little toe side, a big toe side rising part 2, and a little toe side rising part 3. As shown in FIG. 2, in the form including curved surface parts 4, the thickness of the big toe side rising part 2 is greater than the thickness of the little toe side rising part 3. Furthermore, as shown in FIG. 3, the big toe side rising part 2 and the little toe side rising part 3 rise up approximately perpendicularly from the base part 5. Furthermore, as shown in FIG. 4, the form is such that the amount of change in the height of the top part 6 relative to the base part 5 is approximately 0.

EXAMPLE 2

A toe cap was manufactured following the same method as in above-mentioned Example 1, except that fiber-reinforced thermoplastic resin pellets containing 60 wt. % of glass fibers in nylon 6 were used. The form of the manufactured toe cap was also as in Example 1.

EXAMPLE 3

A toe cap was manufactured following the same method as in above-mentioned Example 1, except that fiber-reinforced thermoplastic resin pellets containing 75 wt. % of glass fibers in polypropylene were used. The form of the manufactured toe cap was also as in Example 1.

The clearance height upon an impact energy of 200 J (Joule) was measured for above-mentioned toe caps obtained in Examples 1 to 3. The measurements were carried out following the measurement method in the CEN Standard. The standard value stipulated in this standard is that the clearance height upon an impact energy of 200 J (20 kg×100 cm) is 14 mm, and there are no cracks that let light pass through the cap. The results are shown in Table 1.

TABLE 1

| | Clearance height (mm) 200J (20 kg × 100 cm) impact (26 cm safety shoe) | | |
|---|---|---|---|
| Sample No. | Example 1 Polyurethane GF: 60 wt. % | Example 2 Nylon 6 GF: 60 wt. % | Example 3 Polypropylene GF: 75 wt. % |
| 1 | 16 | 15 | 15 |
| 2 | 20 | 18 | 17 |
| 3 | 18 | 17 | 17 |
| 4 | 17 | 18 | 17.5 |
| 5 | 18.5 | 17.5 | 16.5 |
| Standard value | | 14.0 | |
| Max | 20 | 18 | 17.5 |
| Min | 16 | 15 | 15 |
| Mean | 17.9 | 17.1 | 16.6 |
| Presence of cracks | No | No | No |
| Assessment | Passed | Passed | Passed |

GF: glass fiber

With the toe caps of the present invention, the above measurements were conducted for five impact test samples prepared as described in each of Examples 1 to 3; in all cases the standard value was exceeded, and cracking did not occur, i.e. the impact strength for safety shoe toe caps required in the CEN Standard was satisfied.

EXAMPLE 4

Toe caps were manufactured following the same method as in above-mentioned Example 1, except that fiber-reinforced thermoplastic resin pellets containing varying amounts of glass fibers in polyurethane were used. The form of each of the manufactured toe caps was also as in Example 1.

Regarding Example 4, the relationship between the glass fiber content and the compression strength was studied. The strength measurements were carried out following the measurement method specified in the CEN Standard. The standard value stipulated in this standard is that upon applying a compressive force of 1530 kg, the clearance height is 14 mm, and there are no cracks that let light pass through.

As shown in Table 2, the results of the measurements were that when the glass fiber content was in a range of 45 to 75 wt. %, the standard value stipulated in the CEN Standard was exceeded and cracking did not occur even when a force greater than the compressive force stipulated in the CEN Standard was applied, i.e. all the toe caps met the compression strength level required of safety shoe toe caps in the CEN Standard.

TABLE 2

| Glass fiber content (wt. %) and compression strength (kg) | | | |
|---|---|---|---|
| Glass fiber content (wt. %) | Less than 45% (Vf: less than 27%) | 45~75% (Vf: 27~57.4%) | More than 75% (Vf: more than 57.4%) |
| Compression strength | Less than 1450 | 1640~2430 | Less than 1380 Moldability poor, heavy |

Comparative Example 1

Figure 6:
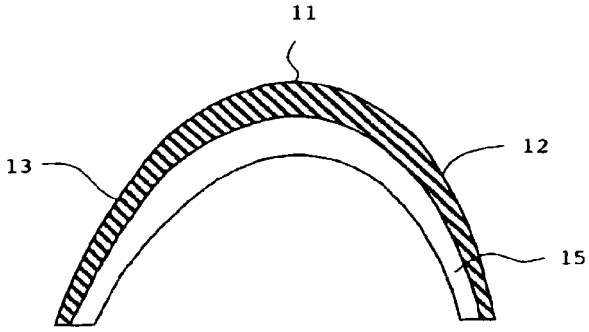
FIG. 6 is a cross-sectional view of a comparative example.
Figure 3:
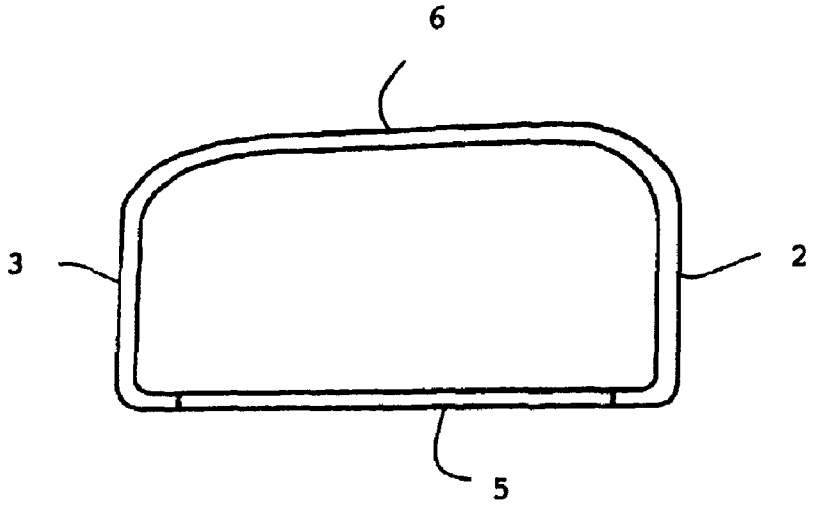
Figure 4:
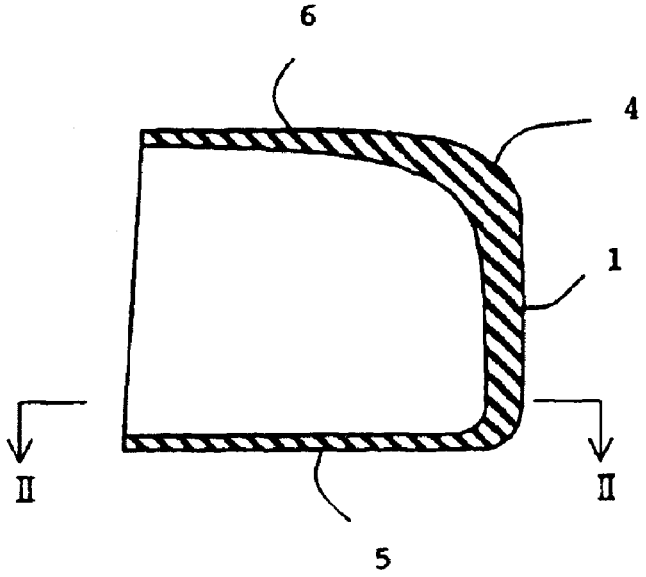
Figure 5:
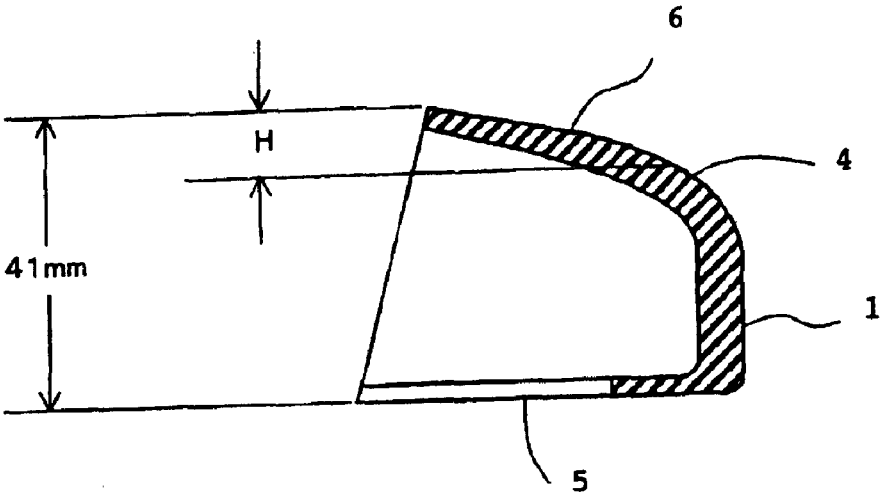
Figure 6:
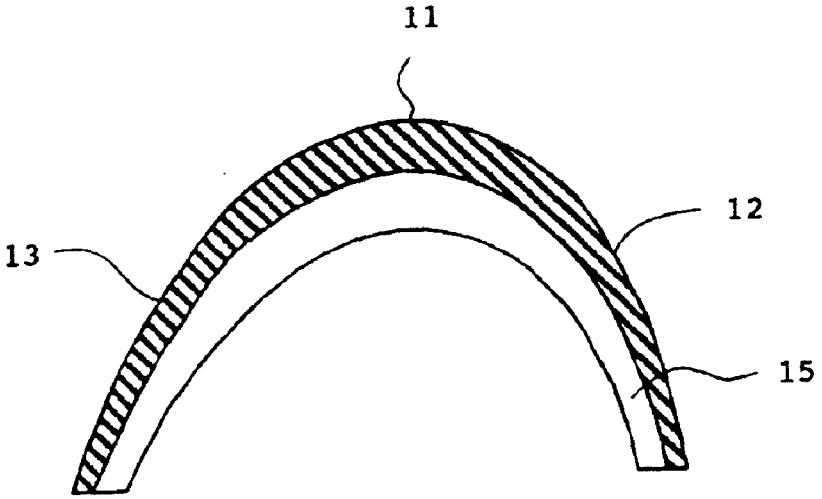

A toe cap was manufactured following the same method as in above-mentioned Example 1. The material used was also as in Example 1. The form of the manufactured toe cap was different from that in Example 1, being as shown in FIG. 6. With the toe cap shown in FIG. 6, the tip part of the front end rising part 11 is displaced to the big toe side, the external shape is a simple curved surface of radius 32.5 mm, and the big toe side rising part 12 and the little toe side rising part 13 have the same thickness.

The clearance height upon an impact energy of 200 J (Joule) was measured for Example 1 and Comparative Example 1, and the results were that for the toe cap of the present invention, the standard value stipulated in the CEN Standard was exceeded, and hence the impact strength for safety shoe toe caps in the CEN Standard was satisfied, whereas for the toe cap of Comparative Example 1, the clearance height fell below the standard value stipulated in the CEN Standard, and cracks occurred in the toe cap. The results are shown in Table 3.

TABLE 3

| Shape of toe cap, and clearance height upon 200J impact | | | |
|---|---|---|---|
| Example 1 (FIG. 2) | Clearance height (mm) | 18.5 | Passed |
| | Presence of cracks | No | |

TABLE 3-continued

| Shape of toe cap, and clearance height upon 200J impact | | | |
|---|---|---|---|
| Comparative Example 1 (FIG. 6) | Clearance height (mm) | 13.8 | Failed |
| | Presence of cracks | Yes | |
| Standard value | Clearance height (mm) | 14.0 | |

EXAMPLE 5

Toe caps were manufactured following the same method as in above-mentioned Example 1. The material used was also the same as in Example 1. In this example, a plurality of toe caps having the sectional shape shown in FIG. 5 were manufactured, with the amount of change (H) in the height of the top part relative to the base part being varied.

The clearance height upon an impact energy of 200 J (Joule) was measured for these manufactured toe caps, and the results were that for toe caps having a height change amount of 7 mm or less, the 200 J impact strength in the CEN Standard was satisfied, whereas for a toe cap having a height change amount of 8 mm, the clearance height fell below the standard value stipulated in the Standard. The results are shown in Table 4.

TABLE 4

Figure 5:
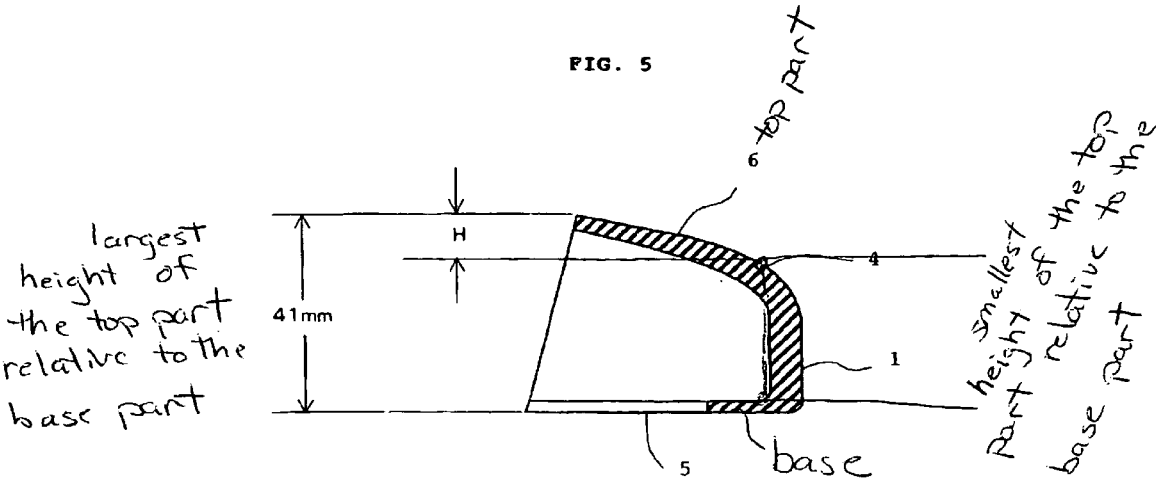
FIG. 5 is a longitudinal sectional view for explaining Example 5.

| Shape of toe cap, and clearance height upon 200J impact | | |
|---|---|---|
| Dimension H (mm) in FIG. 5 | Clearance height (mm) | Assessment |
| 2 | 18.4 | Passed |
| 4 | 18.2 | Passed |
| 6 | 16.3 | Passed |
| 7 | 15.8 | Passed |
| 8 | 13.8 | Failed |
| Standard value | 14.0 | |

According to the resin safety shoe toe cap of the present invention, a safety shoe toe cap can be provided that not only satisfies the performances stipulated in L-class and S-class of JIS T 8101, but also satisfies impact resistance and compression resistance performances stipulated in H-class standards of JIS T 8101 and safety shoe standards in the CEN Standard, without impairing the ability to fit to shoes and wearer's feet.

What is claimed is:

1. A resin safety shoe toe cap made from a fiber-reinforced thermoplastic resin, wherein the toe cap satisfies impact resistance and compression resistance performances stipulated in H-class standards required of safety shoes for heavy work in JIS T 8101;

wherein the resin safety shoe toe cap has rising parts consisting of a front end rising part, a big toe side rising part and a little toe side rising part; a top part; and a base part, wherein the rising parts consisting of the front end rising part, the big toe side rising part and the little toe side rising part are formed so as to rise up approximately perpendicularly to the base part, and wherein the amount of change in the height of the top part relative to the base part is not more than 7 mm.

2. The resin safety shoe toe cap according to claim 1, wherein the thickness of said big toe side rising part is made to be greater than the thickness of said little toe side rising part.

3. The resin safety shoe toe cap according to claim 2, wherein the big toe side rising part and the little toe side rising part are connected to the front end rising part by curved surface parts having different curvatures, and the thicknesses of the big toe side rising part and the little toe side rising part differ at at least said curved surface parts.

4. The resin safety shoe toe cap according to claim 1, wherein the reinforcing fibers are glass fibers, and the thermoplastic resin is at least one selected from the group consisting of nylon, polypropylene and thermoplastic polyurethane.

5. The resin safety shoe toe cap according to claim 1, wherein the reinforcing fibers have a fiber diameter of 0.2 to 5 mm and a length of 10 to 80 mm, and the content by weight of the reinforcing fibers in the fiber-reinforced thermoplastic resin is 45 to 75%.

6. A resin safety shoe toe cap made from a fiber-reinforced thermoplastic resin, wherein the toe cap satisfies impact resistance and compression resistance performances stipulated in safety shoe standards in CEN Standard as a unified European Standard, wherein the resin safety shoe toe cap has rising parts consisting of a front end rising part, a big toe side rising part and a little toe side rising part; a top part; and a base part, wherein the rising parts consisting of the front end rising part, the big toe side rising part and the little toe side rising part are formed so as to rise up approximately perpendicularly to the base part, and wherein the amount of change in the height of the top part relative to the base part is not more than 7 mm.

7. The resin safety shoe toe cap according to claim 6, wherein the thickness of said big toe side rising part is made to be greater than the thickness of said little toe side rising part.

8. The resin safety shoe toe cap according to claim 7, wherein the big toe side rising part and the little toe side rising part are connected to the front end rising part by curved surface parts having different curvatures, and the thicknesses of the big toe side rising part and the little toe side rising part differ at at least said curved surface parts.

9. The resin safety shoe toe cap according to claim 6, wherein the reinforcing fibers are glass fibers, and the thermoplastic resin is at least one selected from the group consisting of nylon, polypropylene and thermoplastic polyurethane.

10. The resin safety shoe toe cap according to claim 6, wherein the reinforcing fibers have a fiber diameter of 0.2 to 5 mm and a length of 10 to 80 mm, and the content by weight of the reinforcing fibers in the fiber-reinforced thermoplastic resin is 45 to 75%.

* * * * *

UNITED STATES PATENT AND TRADEMARK OFFICE

CERTIFICATE OF CORRECTION

PATENT NO. : 6,907,681 B2
DATED : June 21, 2005
INVENTOR(S) : Yoshiharu Tanaka et al.

It is certified that error appears in the above-identified patent and that said Letters Patent is hereby corrected as shown below:

The title page, should be deleted and replaced with the following as attached.

Delete Sheets 2 and 3 of Figures 3-6 of the drawings and replace with the attached two sheets of drawings of Figures 3-6.

Signed and Sealed this

Thirteenth Day of September, 2005

JON W. DUDAS
*Director of the United States Patent and Trademark Office*

(12) United States Patent
Tanaka et al.

(10) Patent No.: US 6,907,681 B2
(45) Date of Patent: Jun. 21, 2005

(54) RESIN SAFETY SHOE TOE CAP

(75) Inventors: Yoshiharu Tanaka, Nyuzen-machi (JP); Mutsuo Hirota, Asahi-machi (JP); Tomohisa Ishida, Kawaguchi (JP)

(73) Assignee: YKK Corporation, Tokyo (JP)

( * ) Notice: Subject to any disclaimer, the term of this patent is extended or adjusted under 35 U.S.C. 154(b) by 33 days.

(21) Appl. No.: 10/455,028

(22) Filed: Jun. 5, 2003

(65) Prior Publication Data

US 2004/0009337 A1 Jan. 15, 2004

(30) Foreign Application Priority Data

Jul. 11, 2002 (JP) ..... 2002-202357

(51) Int. Cl.[7] ..... A43C 13/14
(52) U.S. Cl. ..... 36/77 R; 36/77 M
(58) Field of Search ..... 36/77 R, 77 M

(56) References Cited

U.S. PATENT DOCUMENTS

| | | | | |
|---|---|---|---|---|
| 4,862,606 A | * | 9/1989 | Siskind et al. | 36/77 M |
| 5,331,751 A | | 7/1994 | Harwood | |
| 5,809,666 A | * | 9/1998 | Harwood | 36/77 R |
| 6,333,105 B1 | | 12/2001 | Tanaka et al. | |
| 6,367,170 B1 | * | 4/2002 | Williams | 36/77 M |

FOREIGN PATENT DOCUMENTS

| | | | |
|---|---|---|---|
| DE | 43 20 312 A1 | | 1/1994 |
| EP | 0100181 | * | 2/1984 |
| EP | 1 033 231 A2 | | 9/2000 |
| GB | 2071989 | * | 9/1981 |
| GB | 2 138 272 A | | 10/1984 |
| JP | 2574860 | | 4/1998 |
| JP | 2598209 | | 6/1999 |
| JP | 2000-238142 | | 9/2000 |
| WO | WO 98/48999 | | 11/1998 |

* cited by examiner

*Primary Examiner*—M. D. Patterson
(74) *Attorney, Agent, or Firm*—Michael S. Leonard; Everest Intellectual Property Law Group

(57) ABSTRACT

A resin safety shoe toe cap made from a fiber-reinforced thermoplastic resin, wherein the toe cap resin safety shoe toe cap is constituted from rising parts comprising a front end rising part 1, a big toe side rising part 2 and a little toe side rising part 3; a top part 6; and a base part 5, wherein the thickness of the big toe side rising part 2 is made to be greater than the thickness of the little toe side rising part 3. Moreover, the big toe side rising part 2 and the little toe side rising part 3 are connected to the front end rising part 1 by curved surface parts 4 having different curvatures, and the rising parts are formed so as to rise up approximately perpendicularly to the base part 5. The safety shoe toe cap not only satisfies the performances in L-class and S-class of JIS T 8101, but also the impact resistance and compression resistance performances stipulated in H-class of JIS T 8101 and safety shoe standards in the CEN Standard, without impairing the ability to fit to shoes and wearer's feet.

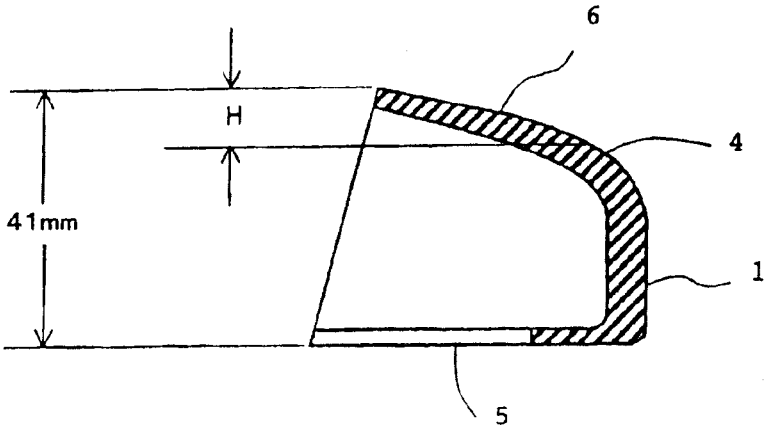

10 Claims, 3 Drawing Sheets